United States Patent [19]

Bruce

[11] 4,447,389

[45] May 8, 1984

[54] METHOD FOR MANUFACTURING TUBES BY SINTERING

[75] Inventor: Lars M. Bruce, Viken, Sweden

[73] Assignee: Uddeholms Aktiebolag, Hagfors, Sweden

[21] Appl. No.: 355,552

[22] PCT Filed: Jun. 10, 1981

[86] PCT No.: PCT/SE81/00173

§ 371 Date: Feb. 2, 1982

§ 102(e) Date: Feb. 2, 1982

[87] PCT Pub. No.: WO81/03633

PCT Pub. Date: Dec. 24, 1981

[30] Foreign Application Priority Data

Jun. 11, 1980 [SE] Sweden ..... 8004338

[51] Int. Cl.[3] ..... B22F 3/00

[52] U.S. Cl. ..... 419/6; 419/5; 419/27; 428/547

[58] Field of Search ..... 419/5, 6, 27; 428/547

[56] References Cited

U.S. PATENT DOCUMENTS

| | | | |
|---|---|---|---|
| 2,227,307 | 3/1939 | Hildabolt | 428/547 |
| 2,695,231 | 4/1954 | Causley | 419/6 |
| 2,843,501 | 7/1958 | Ellis et al. | 419/27 |
| 3,069,757 | 12/1962 | Beggs et al. | 428/547 |

FOREIGN PATENT DOCUMENTS

| | | | |
|---|---|---|---|
| 2702602 | 8/1977 | Fed. Rep. of Germany | 428/547 |
| 2742254 | 3/1979 | Fed. Rep. of Germany | 428/547 |
| 751649 | 7/1956 | United Kingdom | 428/547 |
| 1268917 | 3/1972 | United Kingdom | 428/547 |

*Primary Examiner*—Brooks H. Hunt
*Assistant Examiner*—Anne Brookes
*Attorney, Agent, or Firm*—Beveridge, DeGrandi & Kline

[57] ABSTRACT

The invention relates to a method for manufacturing tubes by sintering and infiltration, the characteristic features of the invention being that the tube wall is formed from a metal powder on a mandrel and is sintered and that the tube wall, during one sintering stage, is sealed by infiltration by means of an infiltration material which solidifies in situ when the temperature is lowered after sintering and which is capable, when in the liquid state, of wetting the metal powder particles, the molding of the tube from the metal powder being preferably carried out by a wet or dry pressing process or by extrusion of the metal powder.

11 Claims, No Drawings

METHOD FOR MANUFACTURING TUBES BY SINTERING

The present invention relates to a method for manufacturing tubes by sintering.

It has long been known to manufacture tubes of ceramic material by extrusion and firing (sintering) in a furnace. It is also known to glaze such tubes at one stage of the firing in order to obtain tight surfaces. Fired, glazed or unglazed clay tubes of circular cross-section in general are manufactured in predetermined lengths, but both the molding process and the firing may be performed continuously, i.e. the molding can be effected by injection molding and the firing can be effected during continuous travel through a tube furnace. If the tubes are to be glazed or enamelled, the glaze or the enamel can be applied for instance by dipping or spraying.

The object of the invention is to provide tight and strong metallic tubes by using this per se known technique as well as metal sintering technique and sealing of sintered bodies by infiltration.

One drawback in connection with the manufacture of ceramic products is that, subsequently to molding and prior to firing, the products require a relatively extended drying time and that the products are sensitive to deformation during a considerable part of the drying time. By suitable peptization it is possible to prepare a slurry of high dry content, such as 65–70%, and such a relatively dry, ceramic mass can be molded in that it is deformable to a great extent without breaking, and can retain its shape with a very slight elastic recovery. The drying time for a ceramic mass of relatively high dry content is of course shorter than for a ceramic mass of lower dry content.

A ceramic raw material mixture is normally carried out as a wet mixture to form a slurry having a 30–50% moisture content, whereupon the starting material can be dewatered in filter presses for preparing a molding compound which can be compression molded or extruded to tubular shape.

Another method is to perform isostatic pressing of a dry ceramic powder under such conditions that the powder is fired at the same time.

Another object of the present invention is to make use of these per se known methods in the manufacture of ceramic products, to produce strong, tight tubes of sintered metal powder, and a particular object is to achieve a method for the manufacture of tubes in which the major portion of the tube wall may be of a relatively coarse-grained structure while the tube wall has a very close inner or outer surface structure with a smooth or slick surface.

As infiltration material may be used a material which is liquid or during the sintering process is liquefied for infiltration of the pores of the molded tube and which after the infiltration process is caused to solidify in situ.

When the tube is molded by extrusion, use can be made of a molding compound consisting of metal powder and a wetting agent. As wetting agent may be used a hydrocarbon, for instance alcohol, which readily evaporates by drying prior to the sintering process or which during the sintering process is readily driven off by heat. A wetting agent in the form of a hydrocarbon can be used for giving the metal powder, such as iron or steel powder, a suitable carbon content, the hydrogen part of the hydrocarbon being useful for reducing oxide inclusions and/or for producing a hydrogen gas atmosphere. It is also possible to use carbon- and hydrogen-based binders, such as binders based on starch or cellulose, the carbon and the hydrogen being useful in the above indicated way during the sintering process.

According to the invention, the entire molding and sintering process can be conducted under vacuum or in protective atmosphere.

The method of performing isostatic pressing of a dry powder may be used in such a manner that dry metal powder is pressed to tubular shape under such a pressure that a certain sintering occurs. Pressing can be conducted in a furnace or the pressed and presintered tube from the pressing station can be introduced in a sintering furnace.

When sintering metal powder mixtures of a particle size of about 250 μm and above, it has proved difficult to obtain smooth surfaces even if infiltration is effected in the direction of a molding surface, for instance in the direction of a mandrel, which is used for forming the cavity of the tube. The reason for this is that a relatively coarse-grained structure will give rise to a tendency to back suction of the infiltration material from the respective tube surface, such as the inner side of the tube, to the material constituting the tube wall when the temperature is lowered after sintering.

According to the invention it has proved possible to overcome this problem by forming the inner side of the tube from a fine-grained metal powder and by forming the rest, i.e. the major portion, of the tube wall from a more coarse-grained metal powder. By carrying out the infiltration at one sintering stage in the direction from the outer side of the tube towards the mandrel and, thus, in a direction from the coarse-grained structure towards the fine-grained structure, there is obtained, by capillary action, a most complete filling of the pores in the fine-grained structure, and back suction of the liquid infiltration material from the fine-grained to the coarse-grained tube wall structure is avoided.

The method of manufacturing the tube wall of at least two metal powders or metal powder mixtures of different average particle sizes however requires at least two molding steps. In the first molding step, a fine powder layer is formed on the mandrel and, in the second molding step, there is formed on the fine powder layer a second layer of metal powder of coarser average particle size, the second layer comprising the major part of the tube wall, if the tube wall is formed of only two layers. The two layers can be formed by extrusion or transfer molding between the mandrel and two nozzles of different diameters, but it is also possible, for example, to form the fine powder layer from a casting or molding compound, i.e. a fine metal powder moistened by a suitable wetting agent as described above, and to form the outer layer from a dry powder by pressing. The reverse procedure is also possible. The molding of the outer layer should of course be so performed that the inner layer is not wrecked, but it is also advantageous to perform the molding of the outer layer in such a manner that sharp interfaces between the inner fine powder layer and the outer layer of coarser powder are eliminated. Therefore, it is preferred that the fine powder layer is stabilized in that the natural bonding tendency between the fine powder grains is increased by means of a suitable bonding promoting agent, such as liquid hydrocarbon, for instance alcohol, or an organic or possibly an inorganic binder.

For the molding in particular of the outer layer of relatively coarse-grained metal powder, pressing or stamping can be effected by means of an annular plunger.

As infiltration material may be used a suitable metal whose melting point is lower than the sintering temperature and which wets the metal grains, but it is also possible to use an enamel slip or a suitable glaze which is easily sucked into the tube wall consisting of metal powder during one sintering phase. For certain purposes, use may be made of plastics, such as teflon or nylon, as infiltration material.

In accordance with the invention, it is of course possible to manufacture tubes in such a manner that the outer layer of the tube wall is made from a fine-grained metal powder or such that both the inner and the outer surface layer of the tube wall are manufactured from a fine metal powder and the rest from a coarser powder.

The manufacture can be performed in steps for the production of tube lengths or in a continuous process. During disengagement the mandrel can be moved successively or be alternatingly advanced and retracted. Sintering may be performed during travel of the molded tube through a furnace, and infiltration may be performed while the mandrel is still inside the tube at the infiltration site, so that the infiltration material is also formed by the mandrel when it penetrates up to the inner side of the tube wall.

I claim:

1. A method for manufacturing tubes comprising molding sinterable powder of metallic material into the shape of a tube between opposed molding surfaces, one of which is the outer circumferential surface of a mandrel, sintering the molded tube while it is supported by the mandrel and, during one sintering stage, sealing the tube by infiltrating therein an infiltratable material which is liquid or liquified at a temperature lower than the maximum sintering temperature used and which is capable of wetting the metal powder particles and of solidifying when the temperature is lowered, the tube being formed with one of its inner or outer circumferential surfaces as a layer of a relatively fine-grained sinterable metallic powder and the rest of the tube being formed of a sinterable metallic powder which is coarser than the fine-grained metal powder, the infiltration of the tube being effected by means of infiltratable material of a nature such that it forms a bond of infiltratable material between the fine grains of the surface as well as between the coarse grains of the rest, and the infiltration being carried out in a direction from the coarse powder towards and into the fine powder while a molding surface is in contact with the fine powder surface that has been formed, and remains in contact with the tube during sintering to shape infiltrating material which penetrates into contact with said molding surface.

2. A method of manufacturing tubes comprising the steps of forming an inner tube wall layer of sinterable metallic powder on a mandrel, forming an outer tube wall layer of sinterable metallic powder on the inner layer, the grain size of the powders formed as the inner and outer layers being unequal such that one layer has a grain size that is coarse and the other layer has a grain size that is fine, providing a forming surface for the layer of fine grained powder while sintering the tube wall and infiltrating therein an infiltratable material which is liquid or liquifiable at the sintering temperature and is capable of wetting the metal powder particles and which solidifies at temperatures below the sintering temperature and forms a bond of infiltratable material between fine-grained and coarse-grained particles, said infiltration being carried out in a direction from the layer of coarse-grained powder towards and into the layer of fine-grained powder.

3. A method as claimed in claim 2 in which the inner layer is the layer of fine-grained particles.

4. A method as claimed in claim 3 in which a bonding promoting agent is added to the layer of fine-grained particles.

5. A method as claimed in claim 3 in which the fine powder layer is formed with a hydrocarbon wetting agent and the coarse powder layer is formed from dry powder by pressing.

6. A method as claimed in claim 3 in which the layers are formed by extrusion.

7. A method as claimed in claim 3 further comprising the step of forming an additional layer of fine-grained sinterable metallic powder on the outer layer before said sintering step.

8. A method as claimed in claim 2 in which the infiltratable material is an enamel slip.

9. A method as claimed in claim 2 in which the infiltratable material is a plastic.

10. A method as claimed in claim 2 in which the infiltratable material is Teflon.

11. A method as claimed in claim 2 in which the infiltratable material is nylon.

* * * * *